United States Patent [19]

Walchli

[11] 4,268,938

[45] May 26, 1981

[54] CLOSURE DEVICE FOR CONTAINER

[75] Inventor: John R. Walchli, Palos Verdes Estates, Calif.

[73] Assignee: Enviropak Inc., El Segundo, Calif.

[21] Appl. No.: 59,975

[22] Filed: Jul. 23, 1979

[51] Int. Cl.[3] ..... A44B 19/10

[52] U.S. Cl. ..... 24/201 C; 150/3

[58] Field of Search ..... 24/201 C; 150/3

[56] References Cited

U.S. PATENT DOCUMENTS

| | | | |
|---|---|---|---|
| 2,666,466 | 1/1954 | Sharat | 24/201 C X |
| 3,049,779 | 8/1962 | Ausnit | 24/201 C |
| 3,430,329 | 3/1969 | Ausnit | 24/201 C X |
| 3,627,600 | 12/1971 | Reiter | 24/201 C X |
| 3,650,009 | 3/1972 | Ausnit et al. | 24/201 C X |
| 3,915,329 | 10/1975 | Zaks | 24/201 C |
| 3,918,131 | 11/1975 | Ausnit | 24/201 C |

FOREIGN PATENT DOCUMENTS

| | | | |
|---|---|---|---|
| 1017293 | 1/1966 | United Kingdom | 24/201 C |

*Primary Examiner*—Roy D. Frazier
*Assistant Examiner*—Peter A. Aschenbrenner
*Attorney, Agent, or Firm*—Edward A. Sokolski

[57] ABSTRACT

A closure device or "zipper" particularly suitable for use with heavy water-tight containers to provide the secure joinder of an opening formed in the container and which can be readily separated to provide access to the interior of the enclosure and/or to permit removal thereof from the object the container is covering. The closure is formed from first and second pieces which are fabricated from a resilient material such as a suitable plastic, each of these pieces having an attachment flap at one end thereof which is secured to an edge portion of the enclosure which is to be joined to an adjacent such edge portion. One of these pieces has an upstanding elongated fastener strip with alternate rib and groove portions which run laterally from the main body of the strip. The second of these pieces has an upstanding riser portion which extends substantially normal from the flap portion, a head portion which runs from the top end of the riser portion substantially normal to the riser portion and a fastener strip which runs from the end of the head portion substantially normal thereto and opposite the riser portion, the riser and head portions and the fastener strip forming a cover for the closure device. The fastener strip of the second piece has elongated alternate ridges and grooves running normal to the main body of the strip similar to that of the first piece, the ridges of the strips of the first and second pieces interlocking together and fitted within the grooves to form a tight joint between the two pieces. A tool is provided to facilitate such joinder.

5 Claims, 5 Drawing Figures

CLOSURE DEVICE FOR CONTAINER

This invention relates to closure devices for containers and bags, and more particularly such a closure device which employs interlocking elongated fastener strips for making a removable joinder along an opening in such a container or bag.

To protect heavy equipment from the environment, particularly where the equipment is to be stored for some period of time, heavy flexible containers, enclosures or covers are often used which completely cover the equipment in a water-tight manner. To provide access to the equipment and to facilitate removal of the covers, a closure or fastener device is generally provided along the opening which may take the form of a "zipper". Metal-type zippers have the shortcoming of tending to jam. Further, such zippers are subject to deterioration in severe environments. Also, with very heavy covers, conventional zippers must take on such large sizes as to be difficult to be opened and closed manually, particularly after they become rusted or corroded. To solve this problem, fastener or closure members have been developed which are made of a plastic material of moderate resiliency, such closure members employing interlocking ridges or ribs which are joined together by applying manual pressure therealong and which can be opened by manually applied prying pressure. Such fasteners are described in U.S. Pat. No. 2,780,261 to Svec et al; U.S. Pat. Nos. 3,054,434 and 3,949,856 to Ausnit. In these prior art devices, the fastener strips are made such that a portion of the outer edge of the joint therebetween is left exposed. This has at least two disadvantages. First, such exposure leaves the possibility of foreign material, such as dirt, water, ice, etc., becoming entrapped in the device, which would of course diminish the effectiveness thereof. Secondly, this exposed edge is susceptible to accidental prying which could lead to accidental opening of the closure.

The device of the present invention is a closure device of the general type described in the aforementioned patents which has novel improved features and overcomes the aforementioned shortcomings of these prior art devices. Further, the device of the present invention is so constructed that it is difficult for one to see where and how the device can be opened, thus affording some security against unauthorized opening.

The improvement is achieved in the device of the present invention by forming one of the closure pieces with a riser portion which rises substantially normally from the container attachment flap for the piece and a head portion which runs substantially normally from the top of the riser portion to a fastener strip which extends substantially normally from the head portion and opposite the riser portion. The second piece has a fastener strip which rises substantially normally from its closure attachment flap, the fastener strips being similar to those of the aforementioned prior art patents, having the same type of interlocking ridges and grooves. By virtue of the novel aforementioned structural configuration of the present invention, access to the closure is provided along the bottom of the strips adjacent to one of the attachment flaps, the top and side portions of the closure being totally contained by the riser portion, head portion and fastener strip portion of the first-described piece which form an effective cover over the joining edges of the closure. With the access portion along the bottoms of the strips, several advantages accrue. First, the likelihood of foreign matter entering the closure is greatly reduced. Second, the likelihood of the device being inadvertently pried open is diminished, and thirdly, the point of access for opening the closure is concealed such as to lessen the chances of unauthorized opening of the closure.

It is therefore an object of this invention to provide an improved closure for securing an opening in a heavy container or bag wherein the likelihood of foreign matter entering the closure is diminished.

It is a further object of this invention to lessen the likelihood of a strip-type container closure from being inadvertently opened.

It is still another object of this invention to provide improved security against authorized opening of a container closure.

Other objects of this invention will become apparent as the description proceeds in connection with the accompanying drawings of which:

Figure 1:
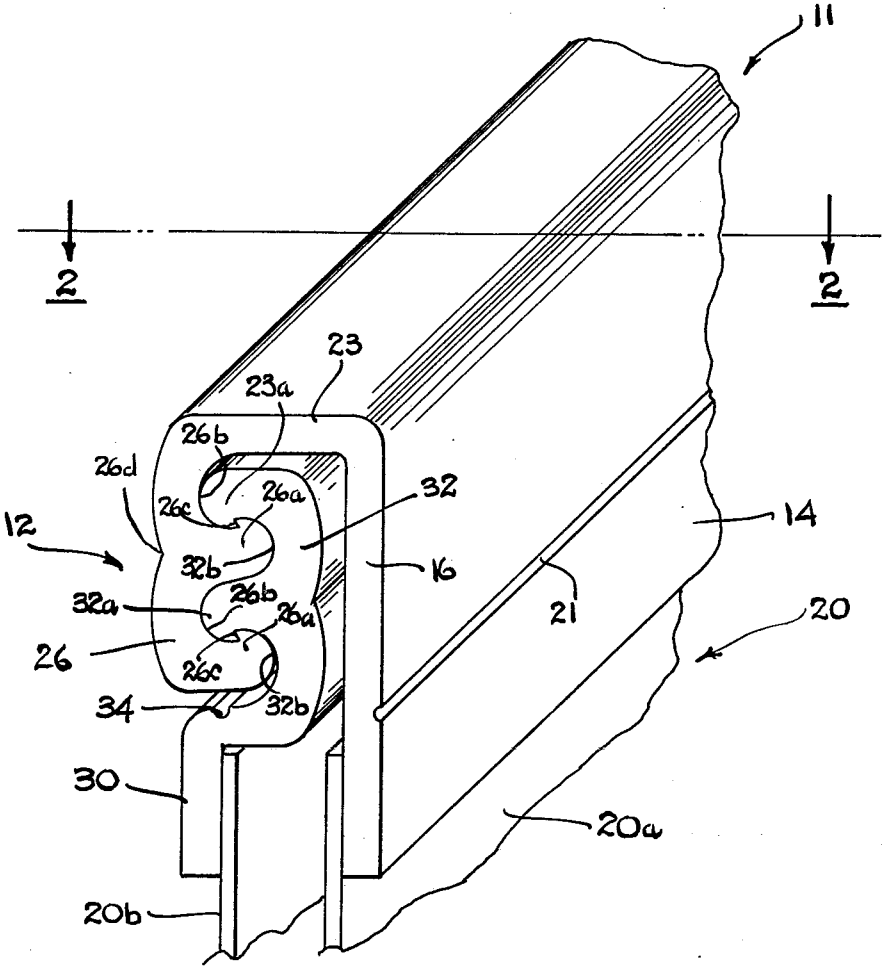
FIG. 1 is a perspective view showing the device of the present invention being utilized to close a container.
Figure 2:
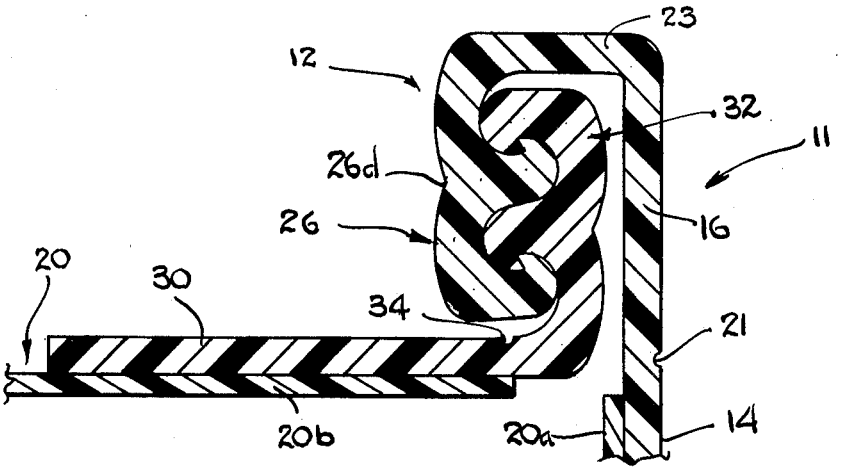
FIG. 2 is a cross-sectional view taken along the plane indicated by 2—2 in FIG. 1.
Figure 3:
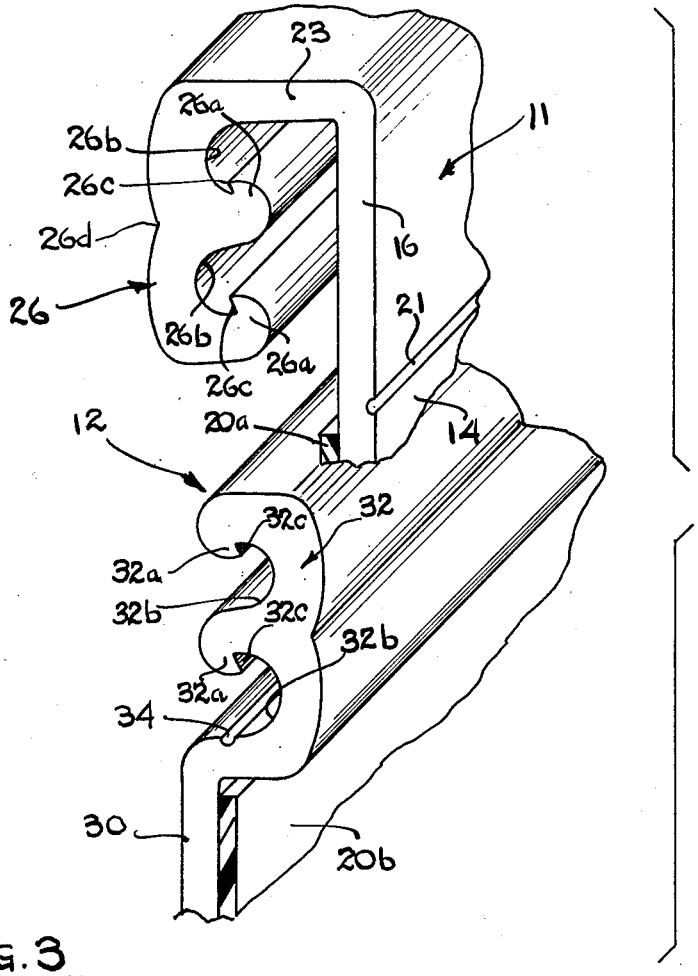
FIG. 3 is a perspective view, partly in cross section, showing the closure of the invention immediately prior to its being joined together.

Referring now to FIGS. 1–3, a preferred embodiment of the invention is illustrated. The closure is formed from a first closure piece 11 and a second closure piece 12, these pieces being elongated in form and of a flexible material, such as a suitable plastic. Pieces 11 and 12 may be extruded from a plastic material, such as urethane rubber. Closure piece 11 includes an attachment flap portion 14 which is joined to an edge portion 20*a* of container 20, for example by cementing or dielectric welding. Rising substantially normally from flap portion 14 is riser portion 16, a bendable joint or hinge being formed between the riser and flap portions by means of slot 21 formed at the elbow between these two portions. Extending from the top of riser portion 16 at an angle substantially normal thereto is head portion 23 which forms a cap for the closure. Fastener strip 26 extends downwardly from the end of head portion 23 at an angle substantially normal to the head portion, the fastener strip being opposite riser portion 16.

Fastener strip 26 has alternate ridge portions 26*a* and groove portions 26*b*, the ridge portions having hooks 26*c* formed at the ends thereof. Formed along the outer wall of fastener strip 26 is a groove 26*d* which, as to be explained further on in the specification, is used for receiving a fastener tool. Closure piece 12 has an attachment flap 30 similar to attachment flap 14, attachment flap 30 being fixedly attached to edge portion 20*b* of container or bag 20, for example, by cementing or dielectric welding. Extending normally from attachment flap portion 30 is fastener strip portion 32 which is similar in configuration to fastener strip 26 and includes alternate ridge and groove portions 32*a* and 32*b*, respectively. The ridge and groove portions of fastener strips 26 and 32 mate in interlocking fashion with the hook portions 26*c* and 32*c* engaging each other. A hinge is formed between attachment flap 30 and fastener strip 32 by means of groove 34. As can be seen, the riser, head, and fastener strip portions of closure piece 11 form an effective cover for the closure such that access is only provided in the space between attachment flap 30 and the bottom of attachment strip 26. This, as already noted, minimizes the chances of foreign material entering the closure device, lessens the likelihood of the closure being inadvertently opened, and provides some degree of security against unauthorized opening of the closure.

Figure 4:
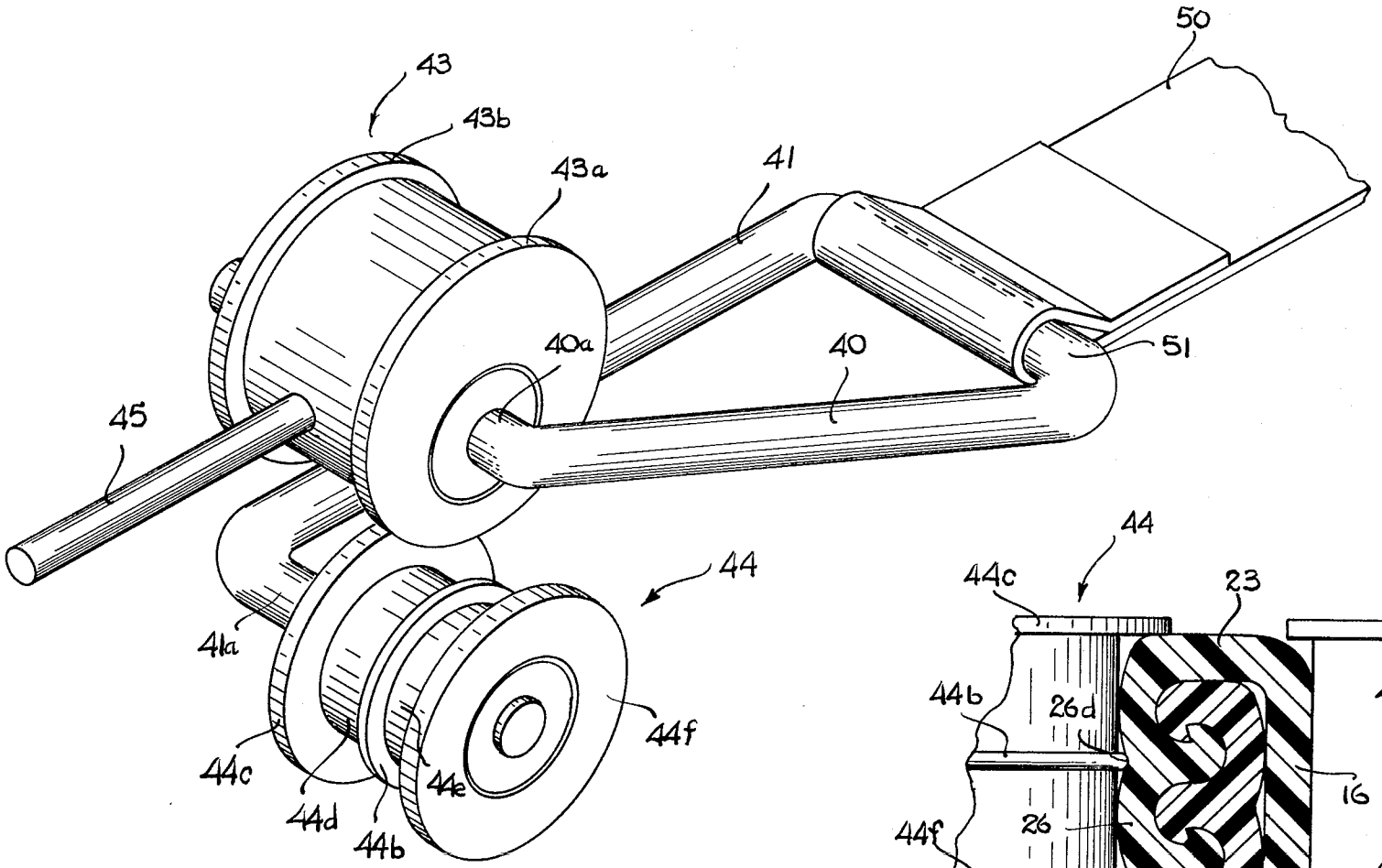
FIG. 4 is a perspective view illustrating a tool which may be employed in joining the closure pieces together.

Referring now to FIG. 4, a tool which may be used in closing the closure is illustrated. This tool has a pair of arm members 40 and 41 which have cross arms 40*a* and 41*a* respectively extending transversely therefrom, one above the other. Rotatably mounted on the cross arm 40*a* is a first larger wheel 43, while rotatably mounted on cross arm 41*a* is a second smaller wheel 44. Wheel 43 has a lever 45 fixedly attached thereto, this wheel being eccentrically mounted on arm 40*a* such that when lever 45 is lowered wheel 43 moves towards wheel 44. Wheel 44 has a pair of grooves 44*d* and 44*e* formed therein, these grooves being separated from each other by a ridge 44*b*. Circular flange portions 44*c* and 44*f* are also formed on the wheel. Wheel 43 has a pair of circular flanges 43*a* and 43*b* formed along the opposite edges thereof. The tool also has a cross arm 51 to which a draw strap 50 is attached.

Figure 5:
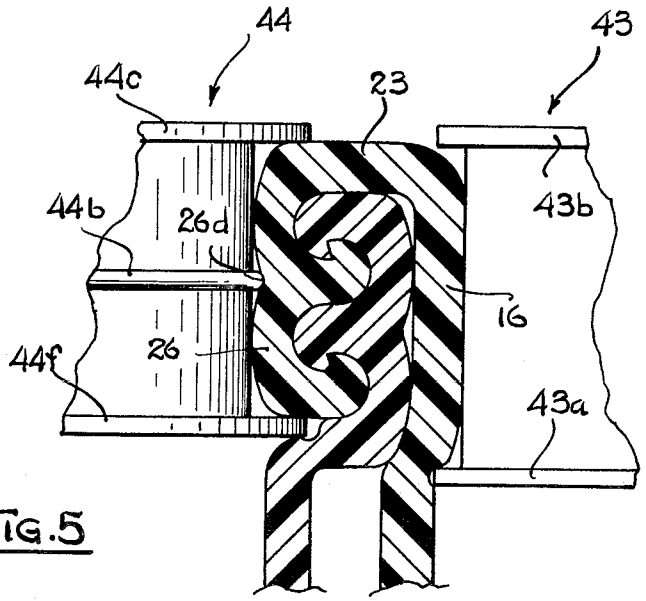
FIG. 5 is a perspective view illustrating the tool being used in joining the two closure pieces together.

Referring now to FIG. 5, the use of the tool in effecting the joinder of the closure pieces together is illustrated. In effecting such operation, the tool is first installed over the oppositely positioned closure pieces with lever 45 raised, as shown in FIG. 4, such that the wheels 43 and 44 are separated from each other. The tool is positioned, as shown in FIG. 5, with wheel 43 abutting against riser 16 of closure piece 11. The inner edge of flange 44*c* of wheel 44 is opposite the top surface of head portion 23 of closure piece 11, while ridge 44*b* of this wheel engages groove 26*d* of attachment strip 26, with the inner edge of flange 44*f* opposite the bottom edge of attachment strip 26. In this position, the two wheels are drawn along the closure by means of draw strip 50 which is attached to cross arm 51 of the tool to join the closure pieces together. The closure device can be opened by applying outward prying finger pressure along the lower edges of fastener strip 26 (adjacent to flap 30).

While the invention has been described and illustrated in detail, it is clearly to be understood that this is intended by way of illustration and example only and is not to be taken by way of limitation, the spirit and scope of this invention being limited only by the terms of the following claims.

I claim:

1. A closure for detachably joining together the edges of an opening in a container, said closure including first and second elongated closure pieces each having an attachment flap attached to one of the edges of said opening and a fastener strip having alternate elongated grooves and hooked ridges which interlock with each other, the improvement wherein means is included in said second piece for forming a cover over the joining edges of said closure comprising:

a riser portion attached at one end thereof to the attachment flap of said second piece and extending substantially normally therefrom and a head portion attached at one end thereof to the other end of said riser portion and extending substantially normally from said riser portion towards the fastener strip of said first piece, the fastener strip of said second piece extending substantially normally from the other end of the head portion and opposite the riser portion, whereby the riser portion, head portion and fastener strip of said second piece form a cover over the closure thereby limiting access to the joinder edge of the closure to the portions thereof directly opposite the attachment flap of the first piece.

2. The closure of claim 1 wherein the riser and head portions of said second piece are in the form of elongated flat strips.

3. The closure of claim 1 wherein the outer wall of the fastener strip of said second piece has an elongated longitudinal groove formed therein adapted to receive a tool for closing the closure.

4. The closure of claim 3 and further including in combination with said closure a tool which closes the closure comprising a pair of arms having cross-arm portions which extend transversely therefrom one above the other, a first larger wheel rotatably mounted on one of said cross-arm portions, a second smaller wheel mounted on the other of said cross arm portions, a lever attached to said first wheel, said first wheel being eccentrically mounted on its associated cross-arm portion such that when said first wheel is rotatably actuated with said lever it moves towards the second wheel, one of said wheels having a pair of grooves separated from each other by a ridge with circular flange portions being formed along the opposite sides thereof, whereby the tool is installed over said closure with the other of said wheels abutting against the riser portion of the closure, one flange of said one of said wheels being opposite the head portion of the closure, one of the flange portions of the second wheel being opposite the head portion of the closure and the ridge of said one of said wheels engaging the longitudinal groove formed in the outer wall of the fastener strip, the lever being actuated to drive said wheels towards each other so as to clamp the closure pieces together.

5. In combination, a closure for detachably joining together the edges of an opening in a container and a tool for closing the closure, said closure including first and second elongated closure pieces each having an attachment flap attached to one of the edges of said opening and a fastener strip having alternate elongated grooves and hooked ridges which interlock with each other, a riser portion attached at one end thereof to the attachment flap of said second piece and extending substantially normally therefrom and a head portion attached to the other end of the riser portion towards the fastener strip of the first piece, the outer wall of the fastener strip of the second piece having an elongated groove therein for receiving the tool, said tool including a pair of arms having cross-arm portions which extend transversely therefrom one above the other, a first larger wheel rotatably mounted on one of said cross-arm portions, a second smaller wheel mounted on the other of said cross-arm portions, a lever attached to said first wheel, said first wheel being eccentrically mounted on its associated cross-arm portion such that when said first wheel is rotatably actuated with said lever it moves towards the second wheel, said second wheel having a pair of grooves separated from each other by a ridge with flange portions being formed along the opposite sides thereof, whereby the tool is installed over said closure with said first wheel abutting against the riser portion of the closure, the inner edge of one of the flange portions of the second wheel being opposite the top surface of the head portion and the ridge of the second wheel engaging the longitudinal groove formed in the outer wall of the fastener strip, whereby when the lever is actuated, said wheels are driven towards each other so as to clamp the closure pieces together.

* * * * *